United States Patent [19]

Maso

[11] Patent Number: 4,793,119

[45] Date of Patent: Dec. 27, 1988

[54] BANDER MACHINE FOR DRUGS CONTAINING CAPSULES

[76] Inventor: Paolo Maso, Via Sabotino, 16, I-40131 Bologna, Italy

[21] Appl. No.: 12,061

[22] Filed: Feb. 6, 1987

[30] Foreign Application Priority Data

Oct. 20, 1986 [EP] European Pat. Off. ..... 86830301.7

[51] Int. Cl.[4] ..... B65B 51/02

[52] U.S. Cl. ..... 53/139.3; 53/329; 53/900

[58] Field of Search ..... 53/900, 329, 416, 419, 53/471, 476, 484, 282, 139.3, 129, 131; 156/69

[56] References Cited

U.S. PATENT DOCUMENTS

| | | | |
|---|---|---|---|
| 2,314,527 | 3/1943 | Taylor | 53/900 X |
| 2,785,786 | 3/1957 | Bartlett . | |
| 2,936,493 | 5/1960 | Scherer | 53/329 X |
| 3,073,087 | 1/1963 | Sandhage et al. | 53/900 X |
| 3,200,556 | 8/1965 | Ackley | 53/329 X |
| 3,927,195 | 12/1975 | Messora | 53/900 X |
| 4,584,817 | 4/1986 | Yamamoto et al. | 156/69 X |
| 4,609,417 | 9/1986 | Smith | 53/329 X |
| 4,677,812 | 7/1987 | Tayebi | 53/900 X |

FOREIGN PATENT DOCUMENTS

| | | |
|---|---|---|
| 456559 | 2/1928 | Fed. Rep. of Germany . |
| 2369969 | 4/1977 | France . |

*Primary Examiner*—Horace M. Culver

*Attorney, Agent, or Firm*—Stevens, Davis, Miller & Mosher

[57] ABSTRACT

A bander machine is disclosed which seals drugs containing capsules by welding a gelatin annular seal on edges of the capsules covers and on lateral surfaces of the capsules bottoms. The machine includes first stations for feeding for the capsules on conveyor belts having an intermittent motion; second gelatin welding stations; third stations in which the capsules are transferred from the first conveyor belts to second conveyor belts; a ventilation chamber for drying the annular seals; fourth capsule removal stations; and baths for cleaning by ultrasound the second conveyor belts.

25 Claims, 10 Drawing Sheets

BANDER MACHINE FOR DRUGS CONTAINING CAPSULES

FIELD OF THE INVENTION

The invention refers to a bander machine for capsules adapted to contain granulated or powdered drugs or similar materials and more particularly it refers to a bander machine essentially comprising: first stations in which feeding device are provided for feeding the capsules on first intermittent feed conveyor belts; second stations in which sealing devices are provided; said devices being able to weld liquid gelatin annular seals around the circumferences which delimit the lower edges of the capsules covers engaged on capsules bottoms; third stations in which said capsules are removed from said first conveyor belts and are disposed on second conveyor belts; said first and second conveyor belts constituting one or more series of conveyor belts; a ventilation chamber in which said annular seals are subjected to a hardening process to statically adhere to the surfaces of said capsules for obtaining sealed capsules; fourth stations form which said sealed capsules are drawn for the subsequent cartoning.

BACKGROUND OF THE INVENTION

Bander machines for drugs capsules are known comprising a conveyor belt able to transfer said capsules from a first feeding station to a second gelatin welding station and, subsequently, it carries the capsules from said second to a third draw station therefor. Said conveyor belt is usually constituted by a plurality of metallic trays disposed in sequence and parallel each other; each tray has a plurality of pits each of which is adapted to house with precision a capsule.

In the known machines it is necessary to simultaneously feed the capsule in the pits of a unique tray, therefore it is necessary for said trays to be sufficiently long to minimize the feeding times. This peculiarity involves a deflection which can reach the size of some millimeters and which can cause very intense jerks in the middle part of the trays during the subsequent movements thereof.

Further, a feeding system like that above disclosed, involves a particularly wide breadthways sizing of the feeding and carrying structures and, therefore, of the bander machine. This makes it difficult to establish bander machines fitted with two or more conveyor belts, therefore the known bander machines are fitted with a unique conveyor belt with the consequent disadvantage of being obliged to stop the treatment process when the machine is subjected to a failure downstream of the first or the second station.

Other disadvantages of the known machines can be noted in the devices for welding said annular seals on the capsules. Particularly these devices are constituted by a roller operated by an electric motor; said roller being partially and longitudinally immersed in said gelatin to bring it from a liquid gelatin tank to the capsules housed in the pits of the trays.

The optimal viscosity values for the welding of liquid gelatin on the capsules depend on the temperature; the gelatin housed in a tank inclines to cool and to loose the optimal viscosity values; for this reason it is necessary to continuously control the viscosity degree and, when necessary, to stop the machine to reset the correct viscosity values of the gelatin. Besides the known machines accomplish the hardening process for the seal after the fall in bulk of the capsules in a zone of the machine downstream of the second station and this causes a possible damaging of the seal not yet hardened.

The known machines have difficulty in flushing the structures adapted for receiving the capsules and the structures adapted for welding liquid gelatin on said capsules. Further, in the known machines, the capsules are disposed in said pits without a specific orientation. Since the edges of the capsules are not exactly on the middle of the longitudinal dimension of said capsules, the welding of the seal in the sealing zone between the covers and the bottoms is not sure.

Finally, the known machines need many movements of the capsules's feeding device able to feed said capsules on the pits, therefore the treatment times become long.

SUMMARY OF THE INVENTION

An object of the present invention is to remedy these drawbacks; the invention, as claimed, solves the problem of how to create a bander machine for drugs containing capsules.

By using a machine in accordance with the present invention, the following aims are achieved; the feeding times of the capsules on the trays are appreciably reduced thus permitting the sealing of an amount of capsules which is at least ten times greater than the amount of capsules sealed by using a known machine.

The advantages reached by using a machine according to the present invention lie in the achievment of an intact seal on every capsules which are disposed on said pits following a desired orientation; in the diminution of the stops of the machine caused by the increased viscosity of the gelatin housed in said tank; in the possibility of associating with the machine an ultrasonic device for cleaning, at the end of a treatment period, the conveyor belts which carry the capsules from said third to said fourth stations.

Besides the machine is provided with two or more series of conveyor belts thereby decreasing the treatment times; increasing the production per hour and allowing the functioning of series of conveyor belts not involved in failures.

Finally the structures of the machine are planned to guide the capsules during the feeding and the removing movements thereof to and from said conveyor belts thus avoiding leaving said capsules at the mercy of movements due to the weight thereof.

The machine according to the present invention is extremely durable.

BRIEF DESCRIPTION OF THE FIGURES

The invention is disclosed in great detail below with reference to drawings which represent two preferred embodiments not limiting the invention in which.

DETAILED DESCRIPTION OF THE INVENTION

Figure 1:
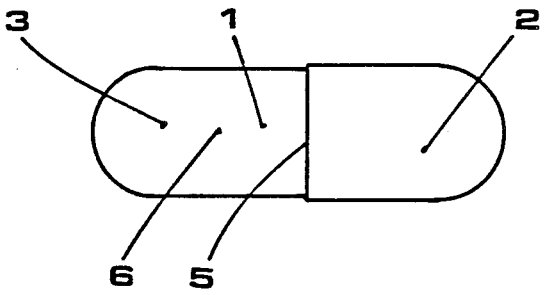
FIG. 1 shows a capsule in a form reaching a first station.
Figure 2:
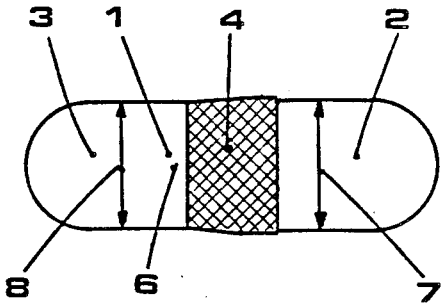
FIG. 2 shows a capsule with an annular gelatin seal.
Figure 3:
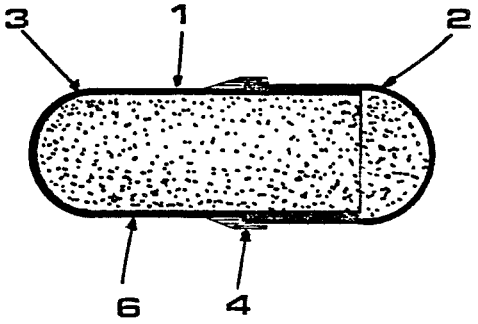
FIG. 3 shows a vertical section view of the capsule of FIG. 2.

As shown in FIGS. 1–3, a capsule 1 able to contain granulated or powdered drugs is constituted by a cover 2 and a bottom 3; an object of the machine is to weld on said capsule 1 a gelatin annular seal 4 for fusing said cover 2 and said bottom 3 together to prevent opening of said capsule 1; said seal 4 being welded on an open edge 5 of said cover 2 and on a lateral surface 6 of said bottom 3 and developing along an annular band.

Figure 5:
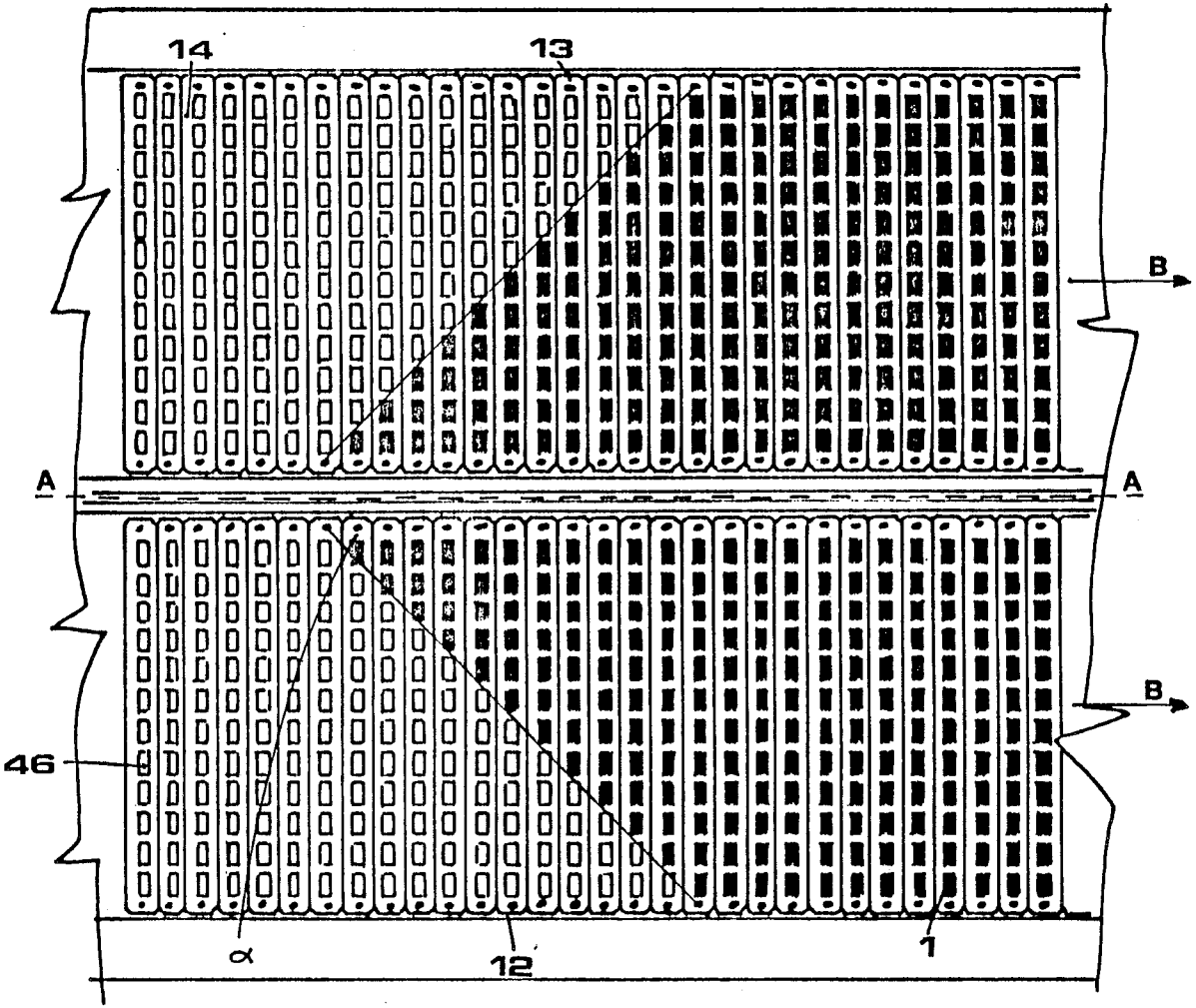
FIG. 5 shows the capsules's feeding system on two first conveyor belts near a feeding station.

As is apparent from FIGS. 1–3, said cover 2 and said bottom 3 have, respectively, external diameters 7 and 8; with said diameter 7 greater than said diameter 8. It is also apparent that said edge 5 is not exactly along the middle of said capsule 1 but it is slightly shifted toward said cover 2, e.g. leftward in FIG. 1. As shown in FIG. 5, the machine according to the present invention is constituted by two identical parts; said parts being symmetrically disposed with respect to a longitudinal symmetry axis A; therefore, it is clear that the structures, elements and devices consituing one of said two parts are identical to the structures, elements and devices relative to the other part. For this reason in the following description we will refer to one of said parts thereby considering disclosed also the remaining part.

Figure 4:
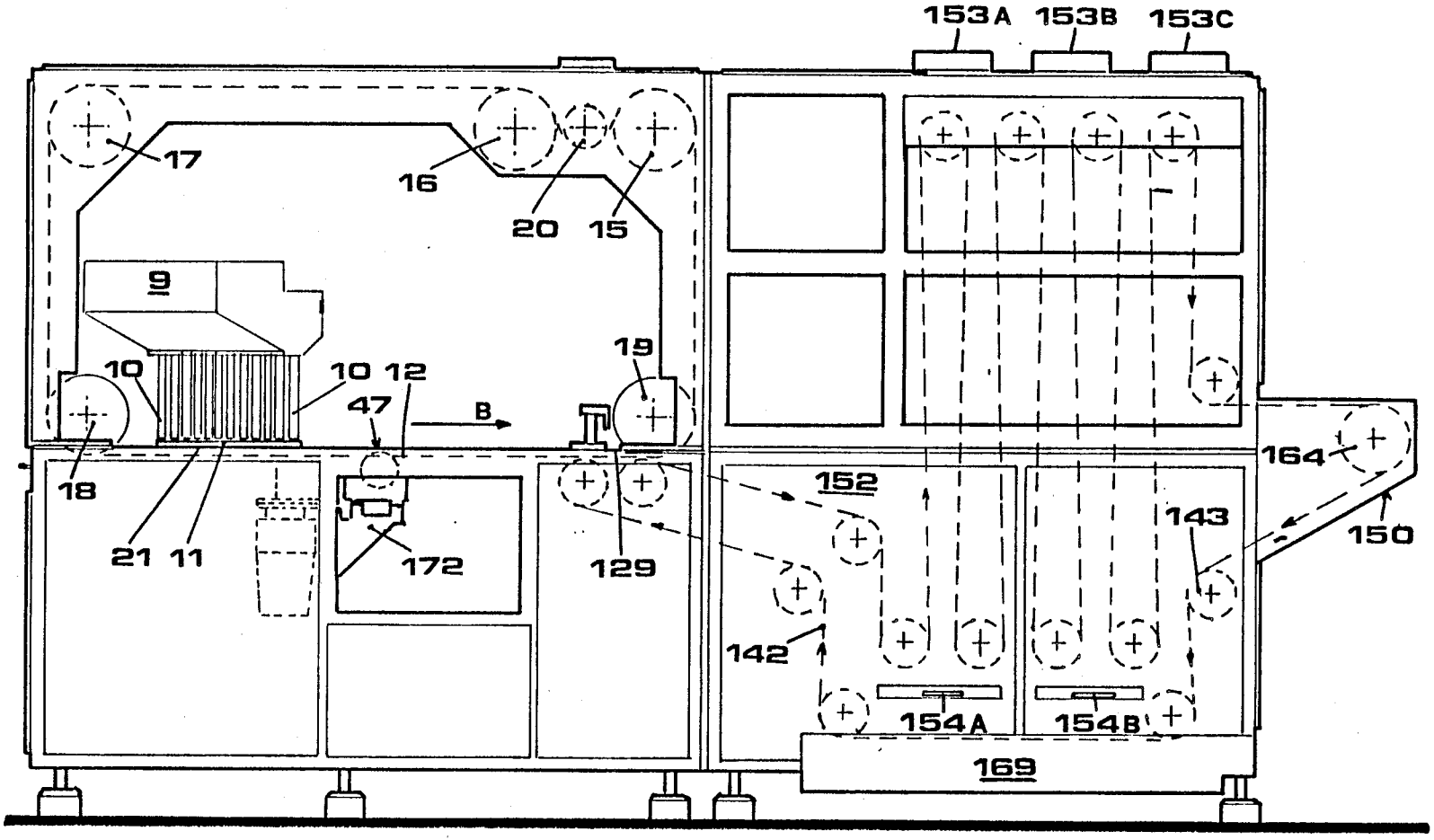
FIG. 4 is a vertical section view of a machine according to the present invention.

As shown in FIG. 4 a feedbox 9 (due to the above-noted symmetry machine is equipped with two feedboxes) houses in bulk capsules 1 not yet sealed (e.g. like that shown in FIG. 1); the lower part of said feedbox 9 is equipped with twelve vertical feeding tubes 10 (twelve in each part) for guiding said capsules to an orientation block 11, disposed below, when said capsules 1 fall due to gravity from said feedbox 9.

Figure 15:
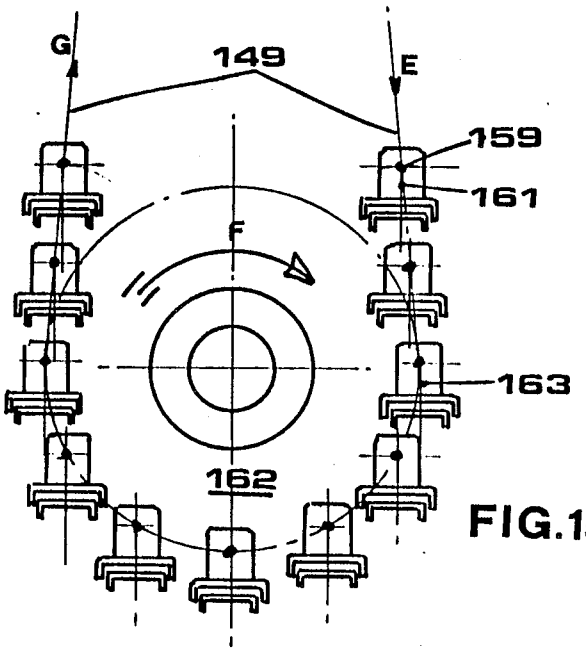
FIG. 15 is a side view of a construction detail of said second conveyor belt.

As is apparent from FIG. 5 the machine is equipped with two conveyor belts 12 and 13 both constituted by a plurality of trays 14 and disposed, respectively, on the right hand and on the left of said axis A; each one of said trays 14 being supported by two propulsion chains, known and not shown, structurally similar to those shown in FIG. 15; said chains being adapted for permitting to said conveyor belts 12 and 13 to move on two closed runs (the run shown in FIG. 4 refers to either of said chains).

Said run is delimited by a motor roller 15, by transmission rollers 16, 17, 18 and 19 and by a chain tightener roller 20; said motor roller 15 giving to its chain a movement according to the direction shown by arrow B.

Said motor roller 15 being kinematically connected with a device, known and commercially available, not shown, adapted for moving said roller 15 with an intermittent motion having stopping and movement times with desired duration and speed.

Each one of said two parts of the machine is provided with a feeding station 21 near said feedbox 9 which is supplied from the top with capsules 1 not yet sealed; each one of said tubes 10 permitting the fall of a unique capsule 1 during each stopping time. Each one of said tubes 10 is connected with a device, known and not shown, adapted to move with said tube 10 between a first position shown in FIG. 6 and a second position shown in FIG. 7 and vice-versa.

A tube 10 has a first upper end 22 disposed inside of said feedbox 9 and a second lower end 23 which opens on said orientation block 11 placed on said first station 21.

Figure 6:
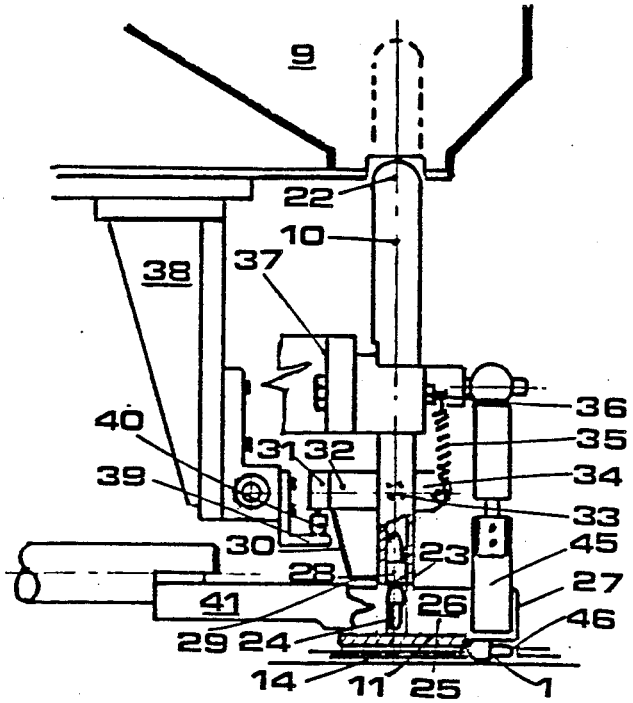
FIG. 6 shows a capsules's feeding device in a first position; said device comprising an orientation block for the capsules.
Figure 7:
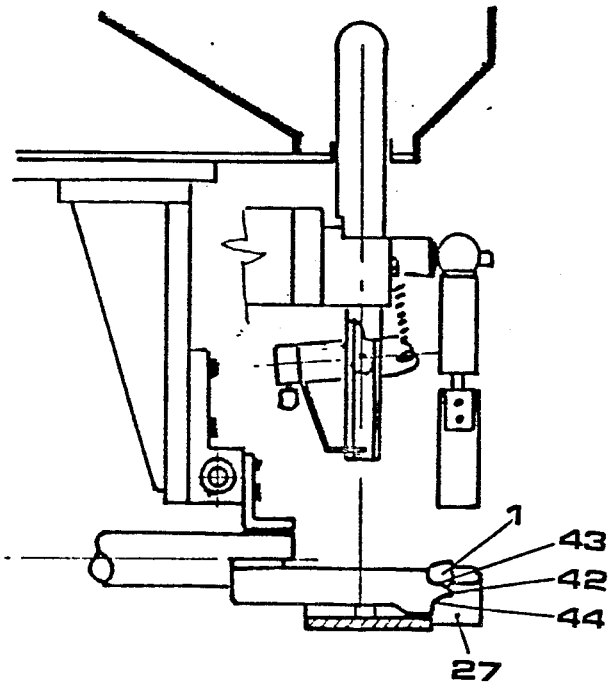
FIG. 7 shows the device of FIG. 6 in a second position.

Said orientation block 11 is schematically shown in FIGS. 6 and 7 and is placed on said station 21 according to an inclination angle $\alpha$ with respect to the direction B of said conveyor belt 12. Said orientation block 11 is known and is provided with twelve vertical axis blind holes and with twelve grooves developing in a first direction parallel to the longitudinal direction of said trays 14 and in a second vertical direction. A blind holw 24 and a groove 25 having a horizontal part 26 and a vertical part 27 are shown in FIGS. 6 and 7; said groove 25 being adapted to contain with precision said cover 2 of a capsule 1 therefore having transversal dimensions identical to the dimensions of said diameter 7.

Said hole 24 is able to support in a quasi-vertical position a capsule 1 coming from said tube 10, and therefore has a diameter identical to or slightly greater than said diameter 7.

The upper end 22 of said tube 10 is equipped with an opening, whose shape is known and not shown, for permitting the feeding of capsules 1 when said tube 10 translates from the position shown in FIG. 7 to the position shown in FIG. 6; the lower end 23 has an opening 28 controlled by a device adapted to permit the fall of a unique capsule 1 from said tube 10 when the latter is in the position shown in FIG. 6, e.g. during a stopping time of said conveyor belt 12, so to dispose said capsule 1 on said hole 24.

To permit the fall of a unique capsule 1 from said tube 10 only during said stopping time, the opening 28 is controlled by a sluice gate 29 supported by a rod 30 integral with a first end 31 of a lever 32 pivoted on a first pin 33 supported by said tube 10; a second end of said lever 32 is connected, by means of a spring 35, with a spring pin 36 supported by a structure 37 integrally embracing said tube 10. Said feedbox 9 supports a bracket 38 with an L-shaped lower end 39 for limiting the downward movements of an adjusting screw 40, arranged in said first end 31, whose positioning determines the start and the completion of the move-away movement of the sluice gate 29 from the opening 28 and therefore said screw 40 is disposed to permit only a unique capsule 1 to be placed on said hole 24 during the transverse movements of said tube 10.

When said screw 40 abuts on said L-shaped end 39, during the downward movement of said tube 10, said lever 32 rotates clockwise against the action of said spring 35 thus allowing the sluice gate 29 to open said opening 28.

It is clear that a capsule 1, housed together with other capsules in said tube 10, is placed in a quasi-vertical position in said hole 24 when said tube 10 is in the position shown in FIG. 6; when said tube 10 returns upward, said screw 40 moves away from said end 30 and therefore said lever 32 is rotated counterclockwise by spring 35 till said sluice gate 29 closes the opening 28.

A first pusher 41, kinematically connected with a device able to move said pusher 41 from the position shown in FIG. 6 to the position shown in FIG. 7 is provided; said pusher 41 is able to be inserted in said groove 25 and has a point 42 and first and second abutments 43 and 44 for causing the transverse movements of said capsule 1 within said groove 25. During the upward translation of said tube 10, said first pusher 41 translates from the position shown in FIG. 6 to the position shown in FIG. 7 for guiding said capsule 1 from the position shown in FIG. 6 to the position shown in FIG. 7 (in a rightward direction). In a first phase of said rightward transverse motion, said capsule 1 is subjected to a rotation movement allowing it to maintain said cover 2 turned toward the direction from which comes said pusher 41; this effect is due to point 42 which moves said capsule 1 away from hole 24 and also due to the fact that the dimensions of said diameter 7 are identical to the dimensions of said groove 25.

In a second phase said capsule 1 abuts on the abutment 43 or 44 of said pusher 41 maintaining said cover 2 turned toward the direction from which comes said pusher 41 (to a leftward direction).

In a third phase said capsule 1 is abandoned by said pusher 41 in said vertical part 27 of said groove 25 in which said capsule 1 remains till a subsequent phase. A second vertical pusher 45, supported by said structure 37, is adapted to be inserted in said vertical part 27 of said groove 25 to permit, when it moves from the position shown in FIG. 7 to the position shown in FIG. 6, the ejection of said capsule 1 from said second part 27 and the subsequent disposition of said capsule 1 on a pit 46 of a tray 14; this is permitted by the fact that said conveyor belt 12 moves with an intermittent motion in the direction of the arrow B; therefore each one of said trays 14 stops at the station 21 for the time necessary to complete the feeding of a pit 46 with a capsule 1.

In view of the above, it is clear that in the first station twelve capsules 1 are fed substantially simultaneously on twelve trays 14 disposed in sequence; therefore, downstream of said station 21 all the covers 2 of said capsules 1 are oriented toward the external part of the machine.

As shown in FIGS. 6 and 7, said structure 37 provides guiding of said tubes 10 during the upward or downward traverse motions thereof. To obtain this effect said structure 37 is kinematically connected with a device, known and not shown, preventing it from undergoing said traverse motions; said device also imparts said traverse motions to pusher 41.

A mechanism suitable for obtaining and transmitting this type of motion is, for example, a shaft rotating around its axis of rotation; said shaft being integral wiith a first lever engaging with a contour of a cam to rotate said shaft in an alternate and intermittent manner.

Preferably two levers connect kinematically said shaft with said structure 37 and, when said shaft rotates clockwise, said structure 37 moves downward and, vice-versa, when said shaft rotates counter-clockwise, said structure 37 moves upward.

Twelve levers connect kinematically said shaft with twelve pushers, identical to pusher 41, and when said shaft rotates clockwise, said pushers move leftward while, when said shaft rotates counter-clockwise, said pushers move rightward.

The feed of said conveyor belt 12 permits to bring said capsules 1, housed in said pits 46, in a gelatin welding station 47 (due to the above-noted symmetry the machine is equipped with a second welding station). To allow a welding of gelatin forming the annular seal 4 two expedients are required: the first expedient is to arrange a widening 48 of the pit 46 near the middle thereof; said pit 46 being shaped for containing a capsule 1 preventing it from falling and allowing it is rotate about its longitudinal axis; the second expedient is to use gelatin spreading disks having an opportune thickness and, more precisely, having a thickness identical to the breadth of the annular seal 4. A gelatin bath **49*a* is disposed in said station 47 (due to the above-noted symmetry, a second gelatin bath is disposed in the second welding station); twelve disks 50, integral and concentric with a rotating shaft 51, being partially immersed in said bath 49*a* for welding gelatin to capsules 1 housed in said pits 46 during a stopping time at said station 47**.

Figure 8:
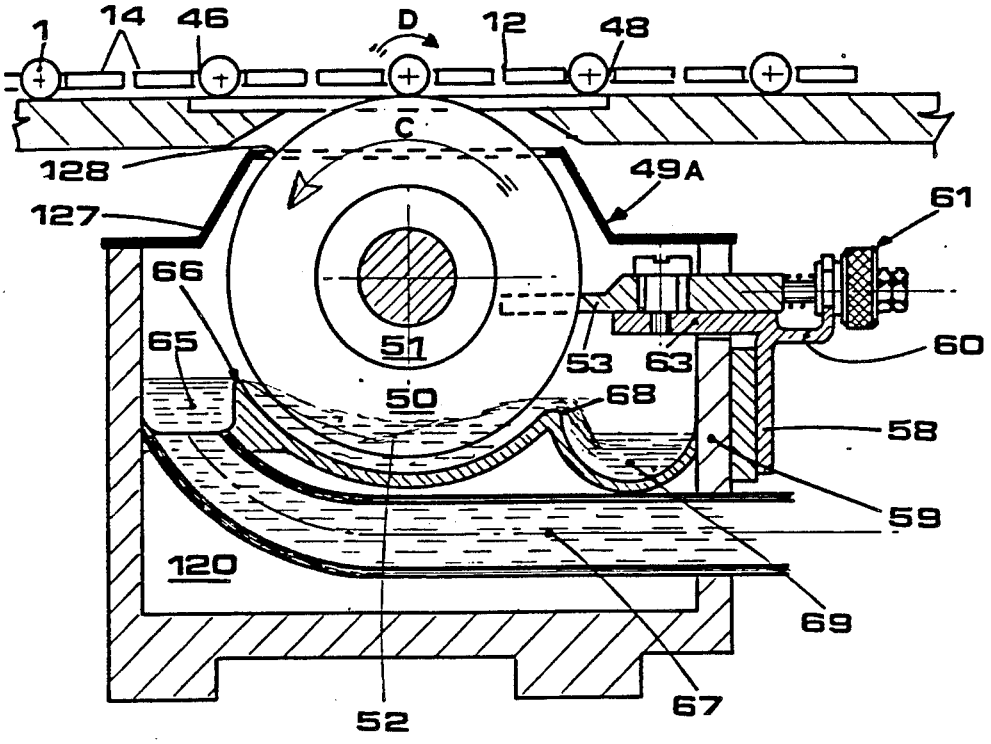
FIG. 8 shows a gelatin bath equipped with the relevant gelatin spreading disks roller; said bath being placed near a welding station for gelatin on said capsules.
Figure 9:
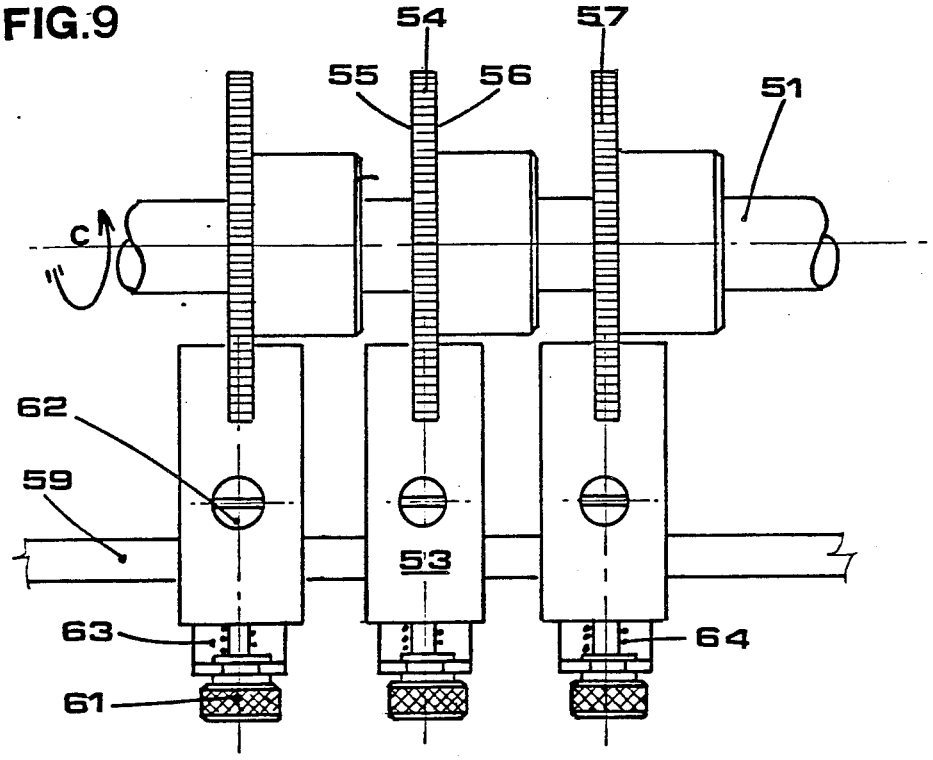
FIG. 9 is a side view of said disks roller.

As is apparent from FIG. 8, the lower part of a disk 50 is immersed in a first gelatin tank 52 and rotates according to the direction shown by arrow C. A scraper element 53 cooperates with said disk 50 to control the amount of gelatin adhering to a contour 54 and to sides 55 and 56 of said disk 50 to prevent an excessive welding of gelatin to capsule 1 rotated, toward the direction shown by arrow D, by the fact that said capsule 1 adheres to said disk 50. Said contour 54 has a knurling 57 permitting a correct gelatin welding on capsule 1 and favoring adhesion between said contour 54 and said edge 5. The presence of gelatin on said contour 54 and the rotation induced to capsule 1 permits a welding of gelatin, in the zone of the edge 5 of the cover 2, which is shaped like the annular seal 4 but which is still liquid till a subsequent phase of treatment for said capsules. To position correctly said scraper 53 relative to disk 50, a bracket 58 integral with a wall 59 of said bath **49*a* is provided; said bracket 58 having an L-shaped part 60 crossed by a positioning and adjusting screw 61 for said scraper 53; the move-away traverse motion from said disk 50 of said scraper 53 is prevented by a fixing screw 62 (FIG. 9) engaging on a horizontal part 63 of said bracket 58; the rotations of said scraper 53 around said screw 62 are prevented by said sides 55 and 56 of said disk 50**.

A spring 64 prevents the unloosening of screw 62 which could be caused by the vibrations induced on said scraper 53 by the movement of said disk 50.

Said first gelatin tank 52 developes along the rotation axis of said shaft 51 to touch said twelve disks housed in said bath **49*a***.

The feeding of gelatin toward said first tank 52 takes place continuously to prevent the formation of film on top and accumulation on the walls of the gelatin tank 52.

Figure 10:
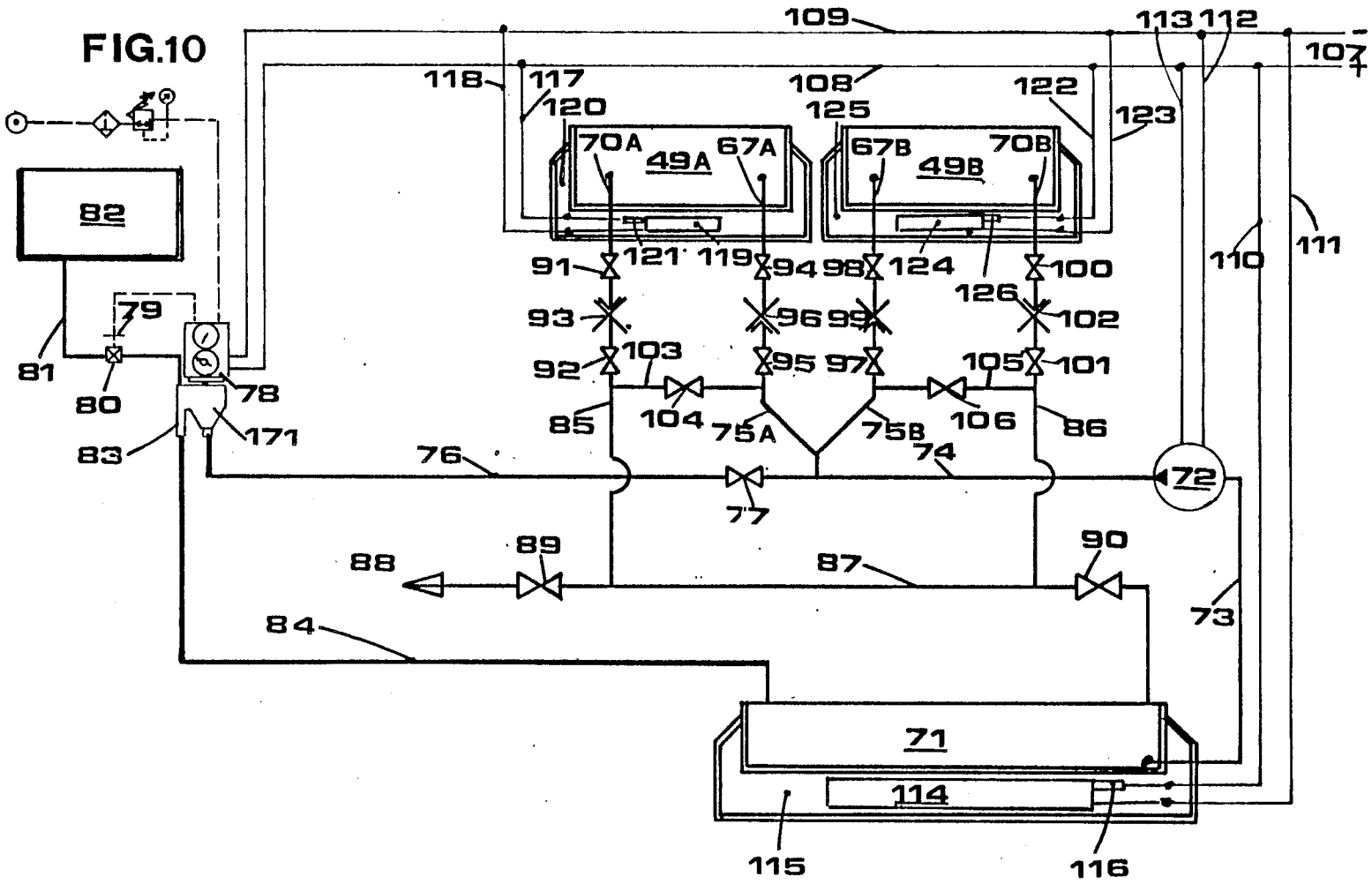
FIG. 10 shows, in block diagram, hydraulic equipement for feeding two gelatin baths and an electric circuit for controlling said feeding.

Said tank 52 communicates via a first overfall threshold 66 with a second tank 65 continuously fed by a delivery channel 67 and, via a second overfall threshold 68, with a third tank 69 connected with a discharge channel 70*a* (70*b* for bath 49*b*), not shown in FIG. 8 but shown in FIG. 10.

The flow rate of gelatin coming from channel 67 is predetermined according to the treatment requirements; said gelatin invades said second tank 66, overtakes the first overfall threshold 65, enters in said first tank 52 from which it is partially drawn for welding on capsules 1 stopping at station 47; the exceeding amount of gelatin overtakes the second overfall threshold 68 and is collected in the third tank 69 to be sent to channel 70*a*. The run of gelatin is better shown in FIG. 10. A main gelatin bath 71 is connected with an electric pump 72 via a feeding channel 73; said pump 72 sends gelatin to two delivery pipes 75*a* and 75*b* with a flow rate adjustable as a function of the treatment requirements; pipes 75*a* and 75*b* are connected, respectively, with said baths 49*a* and 49*b* and having very small longitudinal dimensions for permitting the removal of the casual hardened gelatin. Pipe 74 is connected with a branch 76 for sending gelatin to an inlet 171 of a viscometer 78 fitted with an outlet 83; a throttling valve 77 is disposed between pipes 74 and 76 for sending a desired flow of gelatin to said viscometer 78. This latter is a rotation viscometer, known and available on the market, which measures the viscosity of the gelatin by sensing the drag transmitted by gelatin to a disk or a cylinder rotated continuously by a motor; said viscometer 78 transforms the torque given by the motor to the disk or cylinder in a pneumatic signal sent to a pneumatic valve 79. When the viscosity of the gelatin exceeds a determined value, read in poise, said viscometer 78 operates said valve 79 which opens a faucet 80 disposed in an outlet 81 of a solvent tank 82 for sending said solvent to the outlet 83 of said viscometer 78 for mixing with gelatin. Said solvent can be a gelatin diluted but with a chemical composition similar to the composition of the gelatin circulating in the hydraulic equipment or it can be simpler distilled water. The viscometer 78 is connected with the main bath 71 via a return pipe 84.

The hydraulic equipment comprises also: a first and a second outlet pipe 85 and 86, respectively, of said first and second bath 49*a* and 49*b* and a main return pipe 87 of said main bath 71; said pipe 87 being connected with a drain 88 via a first manual faucet 89; a second manual faucet 90 disposed in said main pipe 87 between the connection of said pipe 87 with said pipes 85 and 86 and the inlet of said pipe 87 and said bath 71; a third and a fourth manual faucet 91 and 92 placed in said pipe 75*a*; a first quick joint device 93 being placed between said third and fourth manual faucets 91 and 92; a fifth and a sixth manual faucet 94 and 95 placed in said pipe 75*b* feeding said second bath 49*b*; a second quick joint device 96 being placed between said fifth and sixth manual faucets 94 and 95. Pipe 85 comprises further: a seventh and an eighth manual faucet 97 and 98; a third quick joint device 99 being disposed between said seventh and said eighth faucets 97 and 98; a nineth and a tenth manual faucet 100 and 101 are disposed in said pipe 75*a*; a fourth quick joint device 102 is disposed between said nineth and said tenth faucets 101 and 102.

A pipe 103 connects said pipe 85 with said pipe 75*a*; and an eleventh manual faucets 104 is placed in said pipe 103. A pipe 105 connects said pipe 86 with said pipe 75*b*; and a twelfth manual faucet 106 is disposed in said pipe 105.

The gelatin feeding hydraulic equipment is provided with an electric circuit connected with a current generator 107 and comprises: a first and a second rheophore 108 and 109 feeding the motor of said viscometer 78; a third and a fourth rheophore 110 and 111 feeding said pump 72; a fifth and a sixth rheophore 112 and 113 feeding a first electric resistance 114 immersed in a thermostatic fluid contained in a first container 115 housing said main bath 71; a first thermostat 116 being arranged at the input of said resistance 14; a seventh and an eighth rheophore 117 and 118 feeding a second electric resistance 119 immersed in a thermostatic fluid contained in a second container 120 housing said bath 49*a*; a second thermostat 121 being placed at the input of said second resistance 119; a nineth and a tenth rheophore 122 and 123 feeding a third electric resistance 124 immersed in a thermostatic fluid contained in a third container 125 housing said second bath 49*a*; a third thermostat 126 being disposed at the input of said resistance 124.

The function of the electric circuit is to feed said pump 72 of said viscometer 78 and said resistance 114, 119 and 124 for maintaining at a desired temperature value the thermostatic fluids contained in said containers 115, 121 and 125.

The hydraulic equipment accomplishes a plurality of functions which can be listed as follows: during the normal working state of the machine, said pump 72 sucks gelatin from said main bath 71 and sends it to pipe 76 which supplies with the same flow rate the pipes 75*a* and 75*b* which, respectively, feed said first and second bath 49*a* and 49*b*; said throttling valve 77 determines a localized loss of load thus permitting the forwarding of a predetermined flow rate of testing gelatin to viscometer 78.

Said pipes 85 and 86 coming out from, respectively, said baths 49*a* and 49*b*, bring again said gelatin to pipe 87 which opens in said main bath 71 thus keeping the gelatin continuously circulating.

During the aforesaid phase, faucets 90, 91 and 92, 94 and 95, 97 and 98, 100 and 101 are open while faucets 89, 104 and 106 are closed.

Should a failure take place downstream of said bath or should the gelatin housed in said bath 49*a* have a viscosity value too high, it is necessary to insulate said bath 49*a* and, when required, to remove it from the machine to accomplish a carefull cleaning thereof. In thus case it is necessary to close said faucets 91, 92 and 97, 98, to disjoint the quick joint devices 93 and 99 and to remove said bath 49*a* from the machine. Then it is necessary to open said faucet 104 to directly connect said pipe 75*a* with pipe 85; in this case the gelatin sent to bath 49*b* courses the aforesaid equipment while the gelatin sent to bath 49*a* returns directly from pipe 75*a* to pipe 85 than to pipe 87 and to main bath 71.

When it is necessary to clean said baths 49*a* and 49*b* without removing them from the machine, said main bath 71 is fed with water; the electric circuit feeding said resistances 114, 119 and 124 is disconnected together with the circuit feeding the motor of said viscometer 78; valve 79 and faucets 90, 104 and 106 are closed and faucet 89 is opened.

Said water crosses said pipe 74, said pump 72, said pipe 76, said pipes 75*a* and 75*b* and reaches said baths 49*a* and 49*b* flushing them; then said water returns toward pipe 87 crossing pipes 85 and 86 and, via said faucet 89, reaches said drain 88 dragging said gelatin which is progressively diluted till its complete fading. This flushing operation is accomplished periodically.

As is apparent from FIG. 8, each one of said two baths 49*a* and 49*b* is covered by a cover 127 fitted with openings 128 for said disks 50; said cover 127 being adapted to prevent the formation of gelatin condensate on parts of the machine different from said baths 49*a* and 49*b*. In order to make said baths 49*a* and 49*b* extractible, said machine is fitted with a shelf 172 equipped with a device able to dispose said shelf 172 in a first position, shown in FIG; 4, or in a second position, not shown, lowered relative to said first position; said device is a worm screw operated manually or, alternatively, a coupling worm screw-worm wheel dimensioned so as to make not reversible the movements thus preventing the weight of said baths to move said shelf 72 from said first to said second position.

Structural elements are provided between said shelf 172 and said bath 49*a* (or 49*b*) to secure the coplanarity therebetween.

The machine is also fitted with a transfer station 129 for transferring said capsules 1 from said first conveyor belt 12 to a second conveyor belt (due to the above-noted symmetry the machine is fitted with a transfer station relative to conveyor belt 13).

Figure 11:
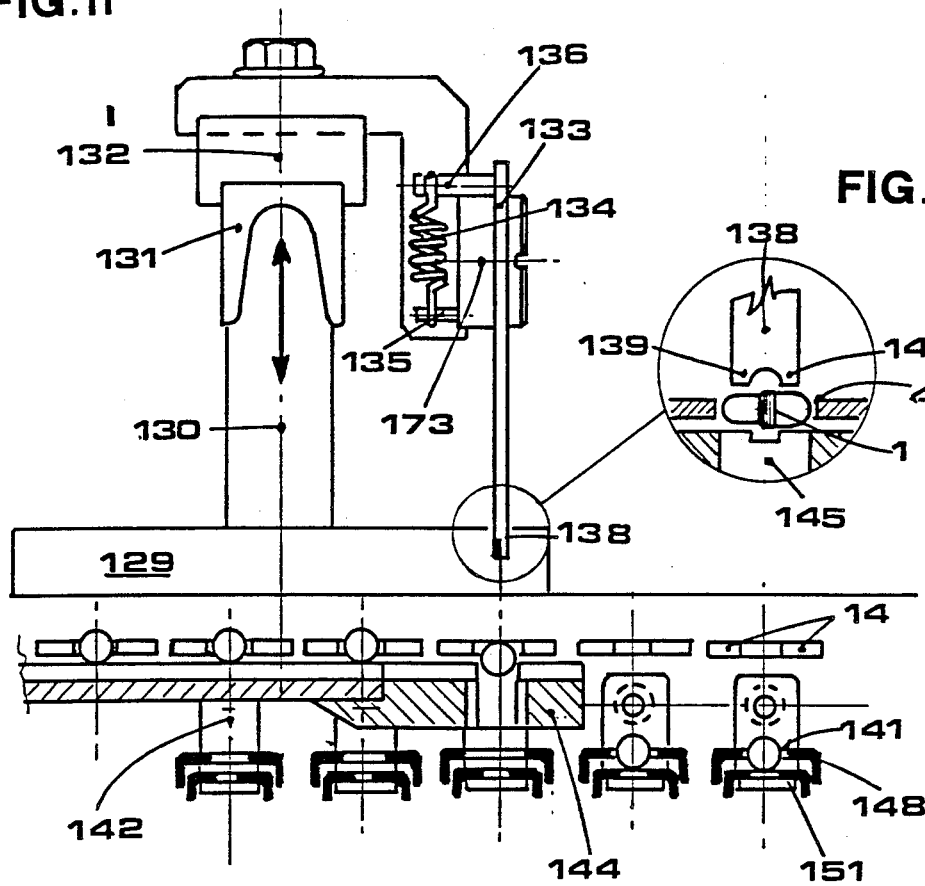
FIG. 11 shows an expeller device for said capsules from said first conveyor belts; said device being placed near a transfer station for the capsules from said first conveyor belts to second conveyor belts.

An expeller mechanism is arranged in said station 129 for ejecting said capsules 1 from said pits 46 of said tray 14 which stops at said station 129. Said mechanism comprises a pair of columns 130 (only one column 130 is shown in FIG. 11); two blocks 131 each of which is supported by a column 130; a first beam 132 supported horizontally by said two blocks 131; first structural means, not shown, positioned on said first beam 132; second structural means supported by said first structural means and supporting a second beam 173 which, in turn, supports twelve pushers 133 arranged over said pits 46; means being present to connect said first beam 132 with said blocks; first fixing means being provided to maintain the position of said first structural means; second fixing means being provided to maintain the position of said second beam.

This structural disposition permits a quick and cheap assembly of pusher 133 in said stations 129 avoiding expensive workings.

To cushion the impact between a pusher 133 and a capsule 1, housed in a pit 46, said pusher 133 is moved upward against the action of the return spring 134 placed on a second spring pin 135 integral with said beam 132 and on a third spring pin 136 integral with said pusher 133; a slot, not shown, is provided in said pusher 133 cooperating with a guiding pin, not shown, integral with a screw 137 to keep the traverse motions of said pusher 133 linear. Said pusher 133 has an end shaped like an overturned U which is formed by two pusher's rods, respectively, right and left 139 and 140 abutting on said capsule 1 but not touching said seal 4 not yet hardened. During the lowering phase said pusher 133 abuts against a capsule 1 housed in a pit 46 of said tray 14 which stops at said station 129.

Under the action of said pusher 133, said capsule 1 crosses said pit 46 and is disposed on a pit 141 of a conveyor belt 142 operated continuously by a motor drum 143 kinematically connected with an electric motor, not shown.

Figure 12:
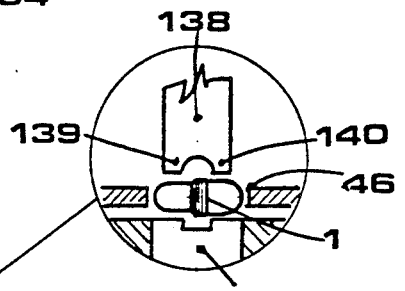
FIG. 12 shows a construction detail of an expeller block.
Figure 13:
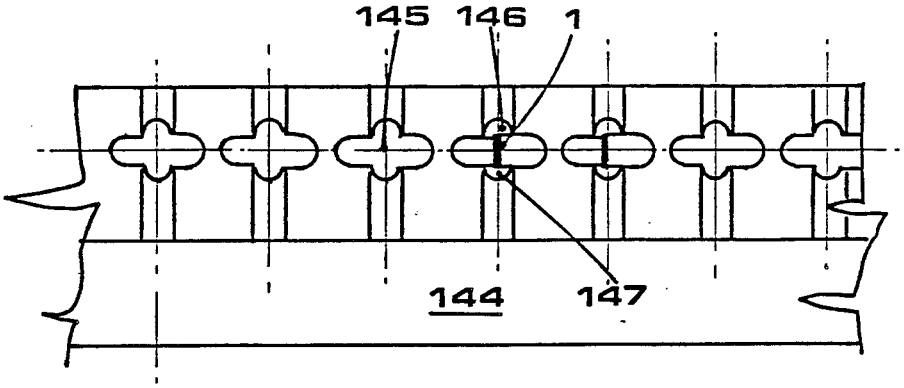
FIG. 13 shows a capsules's guiding plate adapted to control the fall thereof from said first to said second conveyor belt.

To prevent said capsules, after the separation from pits 46, from falling due to gravity in pits 141 disposed under said station 129 thus preventing damage to said seal not yet hardened, said machine is equipped with a passage block 144 better shown in FIG. 12.

Said passage block 144 has twelve through holes 145 shaped similarly to pits 46 but slightly over-dimensioned. In fact said pits 46 house with precision said capsules 1 while holes 145 are dimensioned such to control the fall of said capsules 1 from pits 46 to pits 141.

To prevent annular seals 4, during said fall of capsules 1, which have not yet hardened from being damaged by touching the walls of holes 145, each one of said holes 145 is fitted with two through widenings 146 and 147.

Said pits 141 are shaped like the pits 46 for housing with precision, each, a capsule 1. Said pits 141 being made on racks 148 which concur to form elements of a continuous feed conveyor belt 149 to transfer said capsules 1 from said station 129 to a discharge station 150 (due to the above-noted symmetry, the machine is equipped with a second discharge station relative to the part not disclosed). Said capsules 1 are drawn in continuously from said station 150 for packaging.

Each one of said racks 148 cooperates with a rack 151 to better hold said capsules 1 during the course from said station 129 to said station 150.

Said course developes prevalently inside of a ventilation chamber 152 crossed by air whose humidity and temperature are carefully controlled; said air comes from three inlets 153A, 153B and 153C and exits from two outlets 154A and 154B.

To increase the standing time of capsules 1 in said ventilation chamber 152, said course is lengthened via a certain number of transmission rollers 162 which permit a sufficiently long exposition of capsules 1 to dry air to surely obtain the drying of said seal 4 when said capsules reach the discharge station 150. Two conveyor belts are provided in the machine but, again, only the conveyor belt 149 is illustrated. Said conveyor belt 149 is constituted with two roller chains 155 and 156 (FIG. 15) made in a known manner by closed metallic rings 157 connected with each other by plates 158 with a relative freedom of movement; each one of said rings 157 has a pin 159 on which the ends 160 of said racks 151 are pivoted. Said ends are constituted by structures 161 for forming a U-shape with said racks 151.

Figure 14:
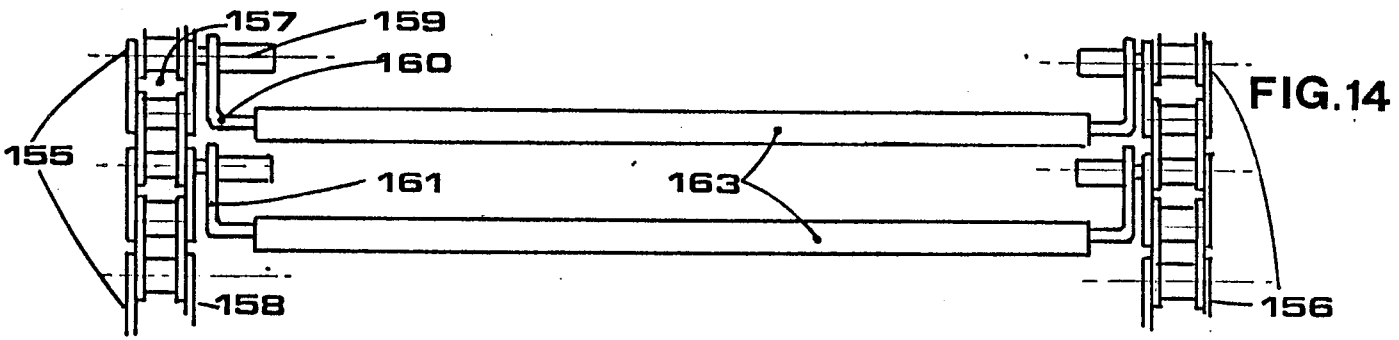
FIG. 14 shows said second conveyor belt in a transmission and veer zone.

Two racks 148 and 151 constitute an element 163 of said conveyor belt 149 and accomplish a static equilibrium mechanical system which determines the horizontal position for the plane of said pits 141 in every direction of movement of said belt 149; in fact the barycenter of said mechanical system is lower relative to pin 159. For this reason said conveyor belt can face even vertical runs without risk of falling for said capsules 1. This concept is illustrated schematically in FIG. 14; a transmission roller 162 permits said conveyor belt 149 to veer; said elements 163 remain parallel to a horizontal plane either during the downward run, shown by arrow E, during the reverse traverse run, shown by arrow F, and during the rise run, shown by arrow G.

The run of said conveyor belt 149 is defined by rollers 162 and by a drum 164 arranged close to said station 150. In effect, to accomplish its function in a correct manner, said conveyor belt needs pairs of rollers 162 and a pair of drums 164; however, for ease of illustration and for analogy with what has been disclosed above and also in view of the symmetry of said conveyor belt 149, it is considered sufficient to disclose a unique series of rollers and a unique drum.

Figure 16:
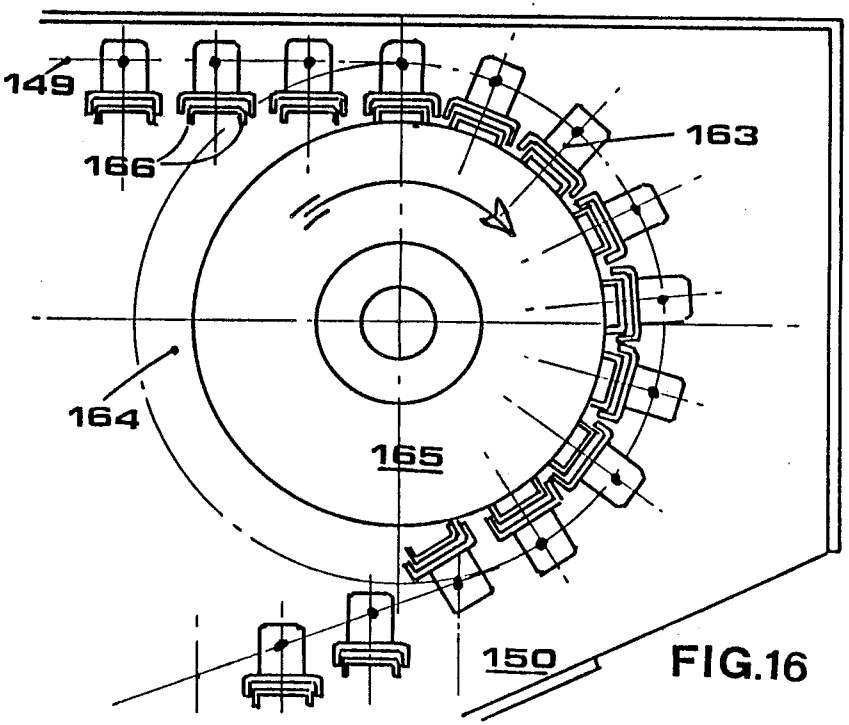
FIG. 16 shows a turnover device for the elements which constitute said second conveyor belt.

Said drum 164 is angularly integral with a hub 165 having a rubber body (or a body of a similar material)

which allows the turnover of said elements 163 in the manner shown in FIG. 16; said hub 165 has a radius equal to the difference between the radius of said drum 164 and the distance between said pin 159 and the lower part 166 of said element 163 such that said part 166 is able to make contact with the wall of said hub 165 for an arc $\omega$ developed in the rotation direction H of said drum 164.

Figure 17:
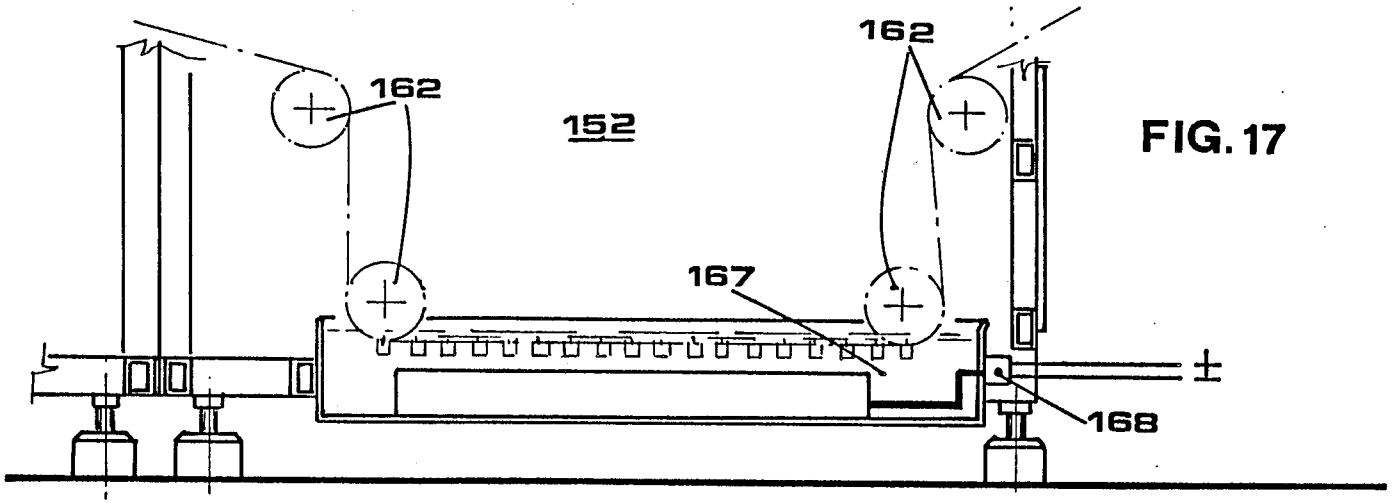
FIG. 17 shows a cleaning bath for said second conveyor belt disposed in a first position.
Figure 18:
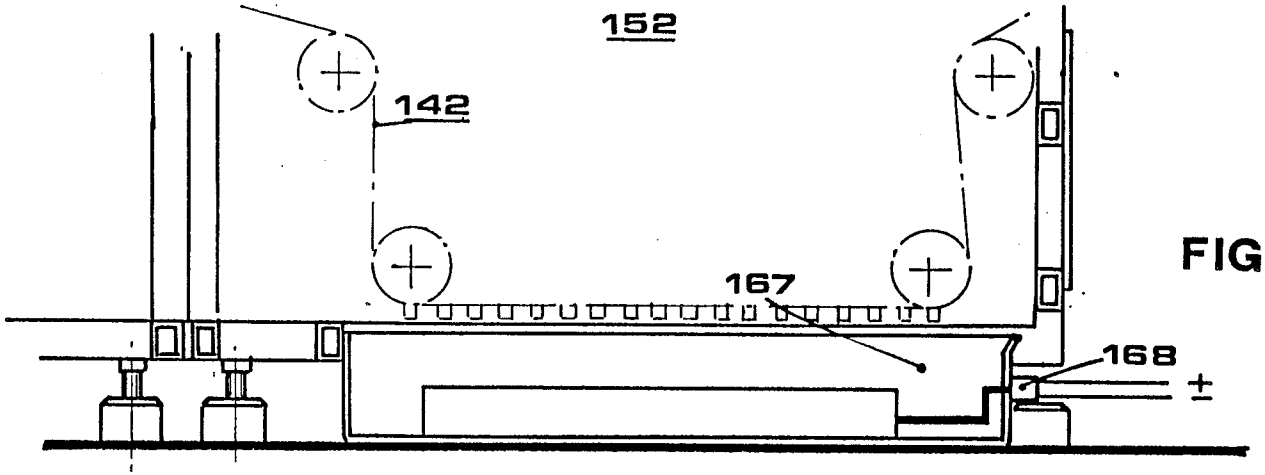
FIG. 18 shows a cleaning bath for said second conveyor belt disposed in a second position.

FIGS. 17–18 show an ultrasonic device for cleaning said elements 163. Said device comprises a bath 167 placed in a lower part of said ventilation chamber 152 and fitted with a mechanism, not shown, for moving said bath from a first position shown in FIG. 17 to a second position shown in FIG. 18 and vice-versa. A suitable mechanism for accomplishing the above disclosed function can be a hydraulic jack placed under said bath 167 and an open disposition articulated parallelogram device.

Said bath 167 is moved toward the position shown in FIG. 17 when the machine is on and toward the position shown in FIG. 18 when the machine has run for a certain time so that therefore said elements 163 must be cleaned.

To accomplish this cleaning, the property is employed of high frequency ultrasounds coming from a transducer 168 and propagating in a proper liquid (e.g. hot water) contained in said bath 167; this property carries on a violent agitation in said liquid allowing the removal of hardened gelatin particles from said elements 163.

Figure 19:
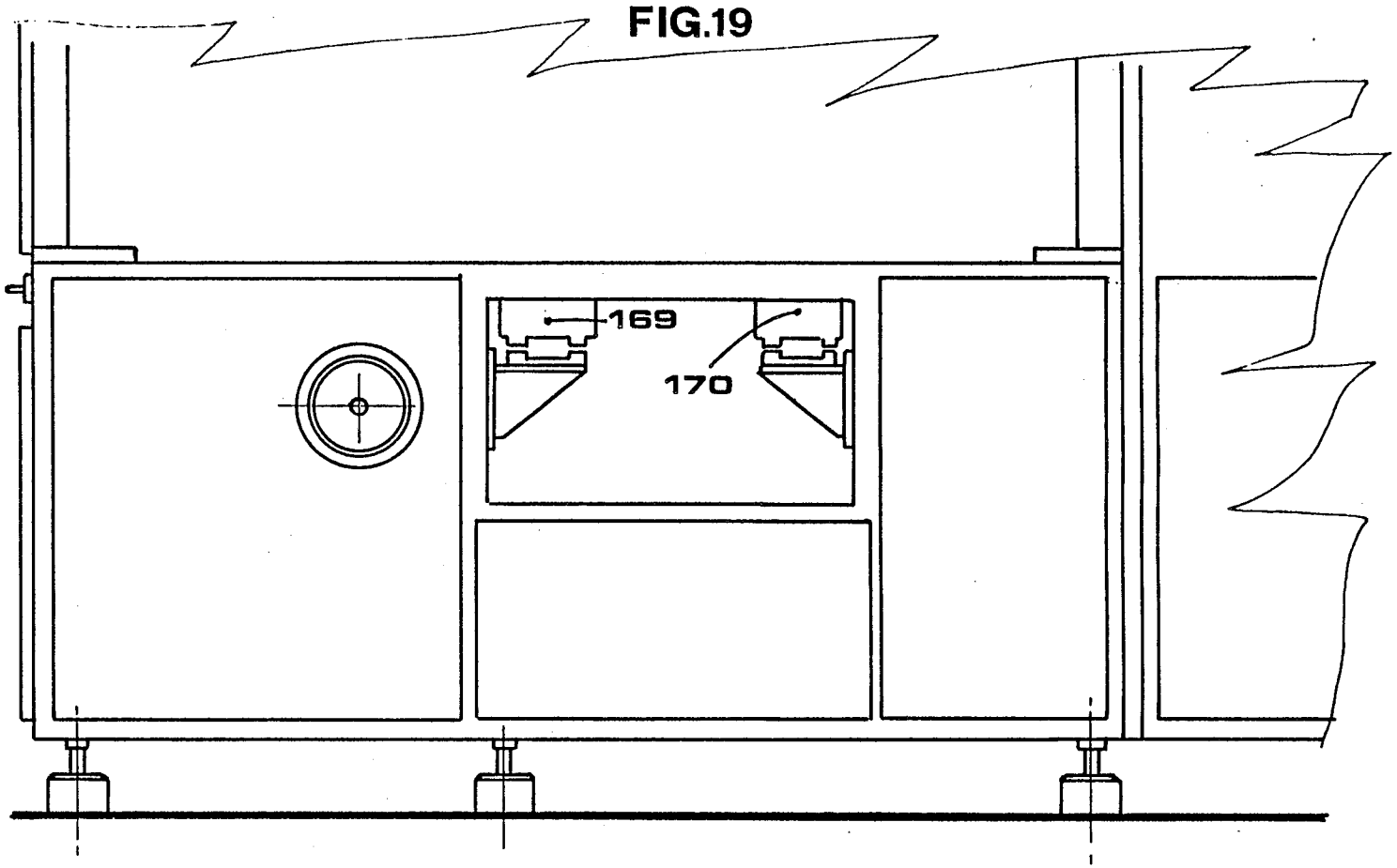
FIG. 19 is a detail of a second embodiment of a machine according to the present invention.

Wide variations can be made to the disclosed embodiment without affecting the essence of the invention. A further embodiment of the machine in accordance with the invention is shown in FIG. 19. As is apparent from said FIG. 19 a machine is equipped with two baths disposed in sequence on the run of the first conveyor belt 12; a first bath 169 containing an aqueous solution with a predetermined proportion of alcohol and a second bath 170 containing gelatin in this case the property is employed of the alcohol acqueous solution to directly seal said edge 5 on the lateral surface 3 of said capsule 1. The mechanical devices for accomplishing this sealing are similar to the above disclosed devices relevant to said baths **49*a* and 49*b***.

Said bath 170 allows the welding of a gelatin band around said edge 5 signaling the accomplished sealing of the cover 2 on the bottom 3. Said band is adapted to have a determined color for best indicating the accomplished sealing. The devices suitable for obtaining this band are similar to the devices relative to said baths **49*a* and 49*b***.

Since the measures of said capsules 1, even if they are standardized, are numerous, the machine is equipped with a suitable number of orientation blocks 11, of trays 14, of racks 148 and 151 and of through blocks 144. Therefore, for each measure of capsules 1 to treat, it is necessary to arrange on the machine the above mentioned mechanical elements opportunely sized.

I claim:

1. A bander machine for capsules containing drugs, said capsules each having a cover portion and a bottom portion, said bottom portion being inserted partially within said cover portion in an overlapping manner such that an edge joint is present between a lower edge of said cover and a lateral surface of said bottom portion, said machine comprising:

(a) a first conveyor belt means for conveying said capsules;

(b) a second conveyor belt means for conveying said capsules;

(c) a first feeding station for feeding said capsules onto said first conveyor belt means;

(d) a drive means for moving said first conveyor belt means intermittently with a predetermined stopping time, running speed and duration of intermittent movement;

(e) a second station for applying an annular layer of liquid gelatin around a circumference of said capsules adjacent said edge joint between said lower edge of said cover and said lateral surface of said bottom portion, whereby when said liquid gelatin dries, it forms an annular seal around said edge joint to prevent opening of said capsules;

(f) a third station for transferring said capsules from said conveyor belt means to said second conveyor belt means;

(g) a ventilation chamber through which said second conveyor belt means passes to dry said liquid gelatin on said capsules to close said annular seal; and (h) a fourth station for removing said capsules from said machine.

2. The machine as in claim 1, further comprising a cleaning bath means for cleaning said second conveyor belt means and a positioning means for moving said cleaning bath means between a first cleaning position adjacent said second conveyor belt means and a second non-cleaning position away from said second conveyor belt means.

3. The machine as in claim 2, wherein said cleaning bath means includes a hot water holder and a high frequency untrasound transducer.

4. The machine as in claim 1 or 2, wherein said first conveyor belt means comprises a plurality of trays each supported by two propulsion chains, said first conveyor belt means travelling along a closed path guided by at least one motor roller and a transmission roller means, each of said trays having a predetermined number of first pits each (i) for housing one of said capsules at a precise location, (ii) permitting said capsules to rotate freely about a longitudinal axis thereof while housed in said pits, and (iii) having dimensions corresponding substantially to a longitudinal cross-section of one of said capsules such that one of said capsles can enter into said pits when pushed by a force having a predetermined magnitude.

5. The machine as in claim 4, wherein each of said first pits has a widest portion adapted to be located adjacent said annular seal of one of said capsules fitted within a said pit, such that non-dried liquid gelatin applied to said capsules by said second station is not disturbed when said capsules are positioned in said pits.

6. The machine as in claims 1 or 2, further comprising (i) a feedbox having a top portion for receiving said capsules prior to said capsules being sealed and including a predetermined number of feeding tubes, (ii) an orientation block positioned under said feeding tubes, said feeding tubes for receiving said capsules from said top portion and guiding said capsules toward said orientation block, and (iii) means for moving said feeding tubes between a first position in which said feeding tubes are in position to place said capsules on said orientation block and a second position in which said tubes are inserted at least partially within said top portion of said feedbox, said feeding tubes and said orientation block being disposed in said first feeding station at a predetermined orientation angle with respect to a direction of movement of said first conveyor belt means, said first position occurring when said first conveyor belt means is stopped and said second position occurring when said first conveyor belt means is advancing.

7. The machine as in claim 6, wherein each feeding tube has a first upper opening for receiving capsules from said top portion of said feedbox during a predetermined time required for said feeding tubes to move from said first position to said second position of said feeding tubes and a second lower opening for permitting an exit of a single one of said capsules from said feeding tubes when said feeding tubes are in said first position, said machine further comprising a control means for controllably blocking said second lower opening to permit said exit when said feeding tubes are in said first position and to prevent said exit when said feeding tubes are in said second position.

8. The machine as in claim 7, wherein said control means comprises (i) a sluice gate connected to a lever mounted on a pivot pin attached to said feeding tubes and (ii) an L-shaped bracket supported to said feedbox, said lever cooperating with said L-shaped bracket responsive to movement of said feeding tubes from said second position to said first position to open said sluice gate for a time period sufficient to enable a said capsule to exit each of said feeding tubes and be disposed on said orientation block.

9. The machine as in claim 6, wherein said orientation block has a predetermined number of holes corresponding to said predetermined number of feeding tubes, said predetermined number of holes being positioned under and close to said predetermined number of feeding tubes, each of said holes being (i) oriented to house a said capsule in a substantially vertical position, (ii) in continuation of a corresponding groove in said orientation block, said groove having a dimension such that it can house a cover of a said capsule in a precise position by a frictional engagement, said groove having a first part oriented in a first direction which is horizontal and parallel with a movement direction of said trays and a second part oriented in a second direction which is substantially vertical, said machine further comprising at least one tray movable along said first conveyor belt means and including a plurality of first pits, a first pusher having a first end disposed in each said groove of said orientation block to transfer a capsule from a said hole through said first part to said second part of said groove while orienting the capsule such that its longitudinal axis is oriented horizontally and its cover is located adjacent said first end of said first pusher and a second pusher operatively connected with a said feeding tube for transferring said capsule from said second part to a said first pit of said tray stopped at said first station, said second pusher being movable to enter into said second part of said groove.

10. The machine as in claim 9, wherein said first end of said first pusher has a point for transmitting a force to said capsule to cause said capsule to undergo a first linear motion component to move toward said second part of said groove and a second rotational motion component caused by friction between said cover of said capsule and a surface of said groove, said first end of said first pusher further comprising a first abutment and a second abutment shaped to receive said capsule after said second rotational motion component is completed and thereafter to transmit to said capsule a second linear motion component within said groove until said capsule is positioned in said second part of said groove.

11. The machine as in claim 1 or 2, further comprising a gelatin application bath means positioned at said second station for applying said gelatin around said capsule at said circumference of said edge joint and comprising (i) an outer container for a thermostatic fluid, (ii) a gelatin bath disposed within a region bounded by said outer container, (iii) feed means for said gelatin bath for feeding gelatin into said gelatin bath over a first overflow threshold means, and (iv) a predetermined number of disks, rotatable on a rotatable shaft and immersed in said gelatin bath, for applying gelatin onto said capsule stopped on said first conveyor belt means at said second station, said container for said thermostatic fluid including an electric resistance means and a thermostat means connected to a current generator.

12. The machine as in claim 11, wherein said gelatin application bath means further comprises a gelatin discharge means for discharging gelatin from said gelatin bath and comprising a second overflow threshold means cooperating with said first overflow threshold means to permit a continuous circulation of gelatin in said gelatin application bath means and a substantially constant amound of gelatin to be maintained in said gelatin bath, said feed means including a delivery channel and said discharge means including a return channel, both said delivery channel and said return channel being connected with said gelatin bath, said delivery channel including a pump connected to said current generator and a throttling valve for controlling a flow rate of said gelatin in said delivery channel, said machine further comprising a viscometer connected to said throttling valve for continuously monitoring the viscosity of said gelatin and for adjusting said viscosity by controllably opening a faucet of a solvent tank connected to said delivery channel to enable solvent to mix with said gelatin, said viscometer being connected with said gelatin bath via a return channel.

13. The machine as in claim 12, further comprising a pipe fitted with a faucet, said delivery channel and said discharge channel being connected to said pipe.

14. The machine as in claim 12, wherein both said delivery channel and said discharge channel include a quick joint means for hydraulically insulating said gelatin bath, said gelatin bath comprising means for permitting removal thereof from said machine.

15. The machine as in claim 12, wherein said discharge channel comprises a gelatin return channel fitted with a first faucet connected to said gelatin bath and a second faucet connected with a drain.

16. The machine as in claim 12, wherein said gelatin application bath means includes a cover having openings in which said disks can be inserted.

17. The machine as in claim 4, wherein said third station includes an expeller means for expelling said capsules from said first pits of a tray stopped at said third station, said expeller means comprising a predetermined number of pushers movable downwardly to forcibly eject said capsules from said first pits, said second conveyor belt means comprising a plurality of second pits, said third station comprising a plurality of through-blocks positioned between said trays and said conveyor belt means and having a predetermined number of through-holes having a shape substantially like but slightly larger than that of said first pits for controlling motion of said capsules from said first pits to said second pits, said through-holes having wide portions at portions thereof adapted to surround said annular seal of said capsules.

18. The machine as in claim 17, wherein each second pusher comprises a lower end having a pair of pusher rods for pressing ends of said capsules without contacting said annular gelatin seal.

19. The machine as in claim 18, wherein each second pusher includes a spring means for cushioning an impact between it and said capsules.

20. The machine as in claim 17, further comprising means for facilitating assembly of said second pushers in said third stations.

21. The machine as in claim 1 or 2, wherein said second conveyor belt means comprises a plurality of second conveyor belts equal in number to a number of first conveyor belts forming said first conveyor belt means.

22. The machine as in claim 1 or 2, wherein said second conveyor belt means comprises a plurality of racks having a predetermined number of second pits each having a shape substantially corresponding to a shape of said capsules, said racks together forming a continuous feed conveyor belt for transferring said capsules from said third station to said fourth station through said ventilation chamber, each of said first and second conveyor belt means comprising a pair of roller chains supporting pins about which ends of said racks are pivoted, said ends of said racks forming a U-shape such that said racks constitute a static equilibrium means for establishing a horizontal position of said second pits during each direction of movement of said second conveyor belt means.

23. The machine as in claim 22, wherein said fourth station comprises a plurality of drums having rubber hub bodies to permit turnover of said racks of said second conveyor belt means, said hub bodies having a radius equal to a difference between a radius of said drums and a distance between said pins and a lower portion of said racks of said second conveyor belt means.

24. A bander machine for capsules containing drugs, said capsules each having a cover portion and a bottom portion, said bottom portion being inserted partially within said cover portion in an overlapping manner such that an edge joint is present between a lower edge of said cover and a lateral surface of said bottom portion, said machine comprising:

(a) a first conveyor belt means for conveying said capsules;

(b) a second conveyor belt means for conveying said capsules;

(c) a first feeding station for feeding said casules onto said first conveyor belt means;

(d) a drive means for moving said first conveyor belt means intermittently with a predetermined stopping time, running speed and duration of intermittent movement;

(e) a second station for applying an aqueous alcohol solution layer on said capsules around a circumference of said capsules adjacent said edge joint between said lower edge of said cover and said lateral surface of said bottom portion, (f) a second station for applying an annular layer of liquid gelatin around a circumference of said capsules adjacent said edge joint between said lower edge of said cover and said lateral surface of said bottom portion, whereby when said liquid gelatin dries, it forms an annular seal around said edge joint to prevent opening of said capsules;

(g) a third station for transferring said capsules from said first conveyor belt means to said second conveyor belt means;

(h) a ventillation chamber through which said second conveyor belt means passes to dry said liquid gelatin on said capsules and to close said annular seal; and (i) a fourth station for removing said capsules from said machine.

25. The machine as in claim 24, further comprising a cleaning bath means for cleaning said second conveyor belt means, and a positioning means for moving said cleaning bath means between a first cleaning position adjacent said second conveyor belt means and a second non-cleaning position positioned away from said second conveyor belt means.

* * * * *